US008304992B2

(12) United States Patent
Ahn

(10) Patent No.: US 8,304,992 B2
(45) Date of Patent: Nov. 6, 2012

(54) PLASMA DISPLAY PANEL INCLUDING A BLACK LAYER

(75) Inventor: Sungyong Ahn, Gumi (KR)

(73) Assignee: LG Electronics Inc., Seoul (KR)

( * ) Notice: Subject to any disclaimer, the term of this patent is extended or adjusted under 35 U.S.C. 154(b) by 873 days.

(21) Appl. No.: 12/295,292

(22) PCT Filed: Dec. 17, 2007

(86) PCT No.: PCT/KR2007/006602

§ 371 (c)(1),
(2), (4) Date: Sep. 30, 2008

(87) PCT Pub. No.: WO2008/072940

PCT Pub. Date: Jun. 19, 2008

(65) Prior Publication Data

US 2009/0109140 A1 Apr. 30, 2009

(30) Foreign Application Priority Data

Dec. 15, 2006 (KR) ..... 10-2006-0129024
Dec. 29, 2006 (KR) ..... 10-2006-0138005

(51) Int. Cl.
*H01J 17/49* (2012.01)

(52) U.S. Cl. ..... 313/586

(58) Field of Classification Search ..... 313/586
See application file for complete search history.

(56) References Cited

U.S. PATENT DOCUMENTS

2002/0047558 A1 4/2002 Whang et al.
2004/0041522 A1* 3/2004 Takada et al. ..... 313/586
2005/0231117 A1* 10/2005 Joo et al. ..... 313/586
2006/0145613 A1 7/2006 Kim
2006/0164011 A1* 7/2006 Lee et al. ..... 313/582
2006/0170354 A1* 8/2006 Hwang ..... 313/582
2007/0278954 A1* 12/2007 Ryu et al. ..... 313/582
2007/0285011 A1* 12/2007 Bae ..... 313/582

FOREIGN PATENT DOCUMENTS

EP 1724807 A2 11/2006
JP 2000-133147 A 5/2000
JP 2002-025451 A 1/2002
JP 2003-151450 A 5/2003
JP 2006-216554 A 8/2006

(Continued)

OTHER PUBLICATIONS

European Search Report dated Nov. 17, 2010 for Application No. 07851571.5, 6 pages.

(Continued)

*Primary Examiner* — Karabi Guharay
*Assistant Examiner* — Michael Santonocito
(74) *Attorney, Agent, or Firm* — Fish & Richardson P.C.

(57) ABSTRACT

The present invention relates to a plasma display panel. The plasma display panel includes a front substrate on which a first electrode and a second electrode are positioned parallel to each other, a first black layer at a position corresponding to the first electrode, a second black layer at a position corresponding to the second electrode, a rear substrate positioned opposite the front substrate, and a barrier rib positioned between the front substrate and the rear substrate to partition a discharge cell. An interval between the first black layer and the second black layer ranges from 0.7 to times a shortest interval between at least one of the first and second black layers and the barrier rib.

8 Claims, 14 Drawing Sheets

FOREIGN PATENT DOCUMENTS

| | | | |
|---|---|---|---|
| JP | 2006-318901 | A | 11/2006 |
| KR | 10-2003-0037487 | A | 5/2003 |
| KR | 10-2004-0102419 | A | 12/2004 |
| KR | 10-2005-0114068 | A | 12/2005 |
| KR | 10-2006-0026607 | A | 3/2006 |
| KR | 10-2006-0068267 | A | 6/2006 |
| KR | 10-2006-0117491 | A | 11/2006 |

OTHER PUBLICATIONS

Korean International Search Report and Written Opinion, dated Mar. 26, 2008 for Application No. PCT/KR2007/006602, 13 pages.

* cited by examiner

PLASMA DISPLAY PANEL INCLUDING A BLACK LAYER

TECHNICAL FIELD

The present invention relates to a plasma display panel.

BACKGROUND ART

The present invention relates to a plasma display panel.

Generally, a phosphor layer and a plurality of electrodes are formed inside a discharge cell partitioned by barrier ribs of the plasma display panel.

When driving signals are applied to the electrodes of the plasma display panel, a discharge occurs inside the discharge cell due to the supplied driving signals. In other words, when the discharge occurs inside the discharge cell due to the supplied driving signals, a discharge gas filled in the discharge cell generates vacuum ultraviolet rays, which thereby cause a phosphor inside the discharge cell to emit light, thus producing visible light. An image is displayed on the screen of the plasma display panel due to the visible light.

DISCLOSURE

Technical Problem

An exemplary embodiment of the present invention provides a plasma display panel capable of improving a contrast characteristic of an image by reducing a panel reflectance.

Technical Solution

A plasma display panel according to an exemplary embodiment of the present invention comprises a front substrate on which a first electrode and a second electrode are positioned parallel to each other, a first black layer at a position corresponding to the first electrode, a second black layer at a position corresponding to the second electrode, a rear substrate positioned opposite the front substrate, and a barrier rib positioned between the front substrate and the rear substrate to partition a discharge cell, wherein an interval between the first black layer and the second black layer ranges from 0.7 to 2.5 times a shortest interval between at least one of the first and second black layers and the barrier rib.

The interval between the first black layer and the second black layer may range from 0.8 to 1.8 times the shortest interval between at least one of the first and second black layers and the barrier rib.

The plasma display panel may further comprise a third black layer on the front substrate at a position corresponding to the barrier rib.

The plasma display panel may further comprise a fourth black layer on an upper portion of the barrier rib.

A shortest interval between at least one of the first and second black layers and the fourth black layer may be substantially equal to the shortest interval between at least one of the first and second black layers and the barrier rib.

The first electrode and the second electrode may each include a transparent electrode and a bus electrode. The first and second black layers may be positioned between the transparent electrodes of the first and second electrodes and the bus electrodes of the first and second electrodes, respectively.

The first electrode and the second electrode may be spaced apart from the barrier rib parallel to at least one of the first electrode and the second electrode.

The shortest interval between the barrier rib and the first black layer may be substantially equal to the shortest interval between the barrier rib and the second black layer.

The shortest interval between the barrier rib and the first black layer, the shortest interval between the barrier rib and the second black layer, and the interval between the first black layer and the second black layer may be substantially equal to one another.

The barrier rib may include a first barrier rib parallel to the first and second black layers, and a second barrier rib intersecting the first barrier rib. A fifth black layer may be positioned on the front substrate at a position corresponding to the second barrier rib to intersect the first and second black layers.

The first electrode and the second electrode may each include a transparent electrode and a bus electrode. Each of the transparent electrodes of the first and second electrodes may include a first portion which does not overlap the first black layer or the second black layer, a second portion which does not overlap the first black layer or the second black layer, a distance from the second portion to the middle of the discharge cell being shorter than a distance from the first portion to the middle of the discharge cell, and a third portion which is positioned between the first portion and the second portion and overlaps the first black layer or the second black layer. A length of a cross section of the second portion may be shorter than a length of a cross section of the first portion.

A plasma display panel according to an exemplary embodiment of the present invention comprises a front substrate on which a first electrode and a second electrode are positioned parallel to each other, a first black layer at a position corresponding to the first electrode, a second black layer at a position corresponding to the second electrode, a rear substrate positioned opposite the front substrate, a barrier rib positioned between the front substrate and the rear substrate to partition a discharge cell, and a third black layer on the front substrate at a position corresponding to the barrier rib, wherein an interval between the first black layer and the second black layer ranges from 0.7 to 2.5 times a shortest interval between at least one of the first and second black layers and the third black layer.

The interval between the first black layer and the second black layer may range from 0.8 to 1.8 times the shortest interval between at least one of the first and second black layers and the third black layer.

The shortest interval between the third black layer and the first black layer, the shortest interval between the third black layer and the second black layer, and the shortest interval between the first black layer and the second black layer may be substantially equal to one another.

The first electrode and the second electrode may each include a transparent electrode and a bus electrode. Each of the transparent electrodes of the first and second electrodes may include a first portion which does not overlap the first black layer or the second black layer, a second portion which does not overlap the first black layer or the second black layer, a distance from the second portion to the middle of the discharge cell being shorter than a distance from the first portion to the middle of the discharge cell, and a third portion which is positioned between the first portion and the second portion and overlaps the first black layer or the second black layer. A length of a cross section of the second portion may be shorter than a length of a cross section of the first portion.

A plasma display panel according to an exemplary embodiment of the present invention comprises a front substrate on which a first electrode and a second electrode are positioned parallel to each other, the first electrode and the second electrode each including a transparent electrode and a bus electrode, a rear substrate positioned opposite the front substrate, a barrier rib positioned between the front substrate and the rear substrate to partition a discharge cell, and a third black layer on the front substrate at a position corresponding to the barrier rib, wherein an interval between the bus electrodes of the first and second electrodes ranges from 0.7 to 2.5 times a shortest interval between at least one of the bus electrodes of the first and second electrodes and the third black layer.

The interval between the bus electrodes of the first and second electrodes may range from 0.8 to 1.8 times the shortest interval between at least one of the bus electrodes of the first and second electrodes and the third black layer.

Each of the transparent electrodes of the first and second electrodes may include a first portion which does not overlap the bus electrode, a second portion which does not overlap the bus electrode, a distance from the second portion to the middle of the discharge cell being shorter than a distance from the first portion to the middle of the discharge cell, and a third portion which is positioned between the first portion and the second portion and overlaps the bus electrode. A length of a cross section of the second portion may be shorter than a length of a cross section of the first portion.

A degree of darkness of the bus electrode may be higher than a degree of darkness of the transparent electrode.

The bus electrode may include a black material having electrical conductivity.

ADVANTAGEOUS EFFECTS

A plasma display panel according to the present invention reduces a panel reflectance using an eclipse effect by relatively widening an interval between a first black layer or a second black layer positioned between a first electrode or a second electrode and a front substrate and a barrier rib, and thus improves a contrast characteristic of an image displayed on the plasma display panel.

BEST MODE

Figure 1:
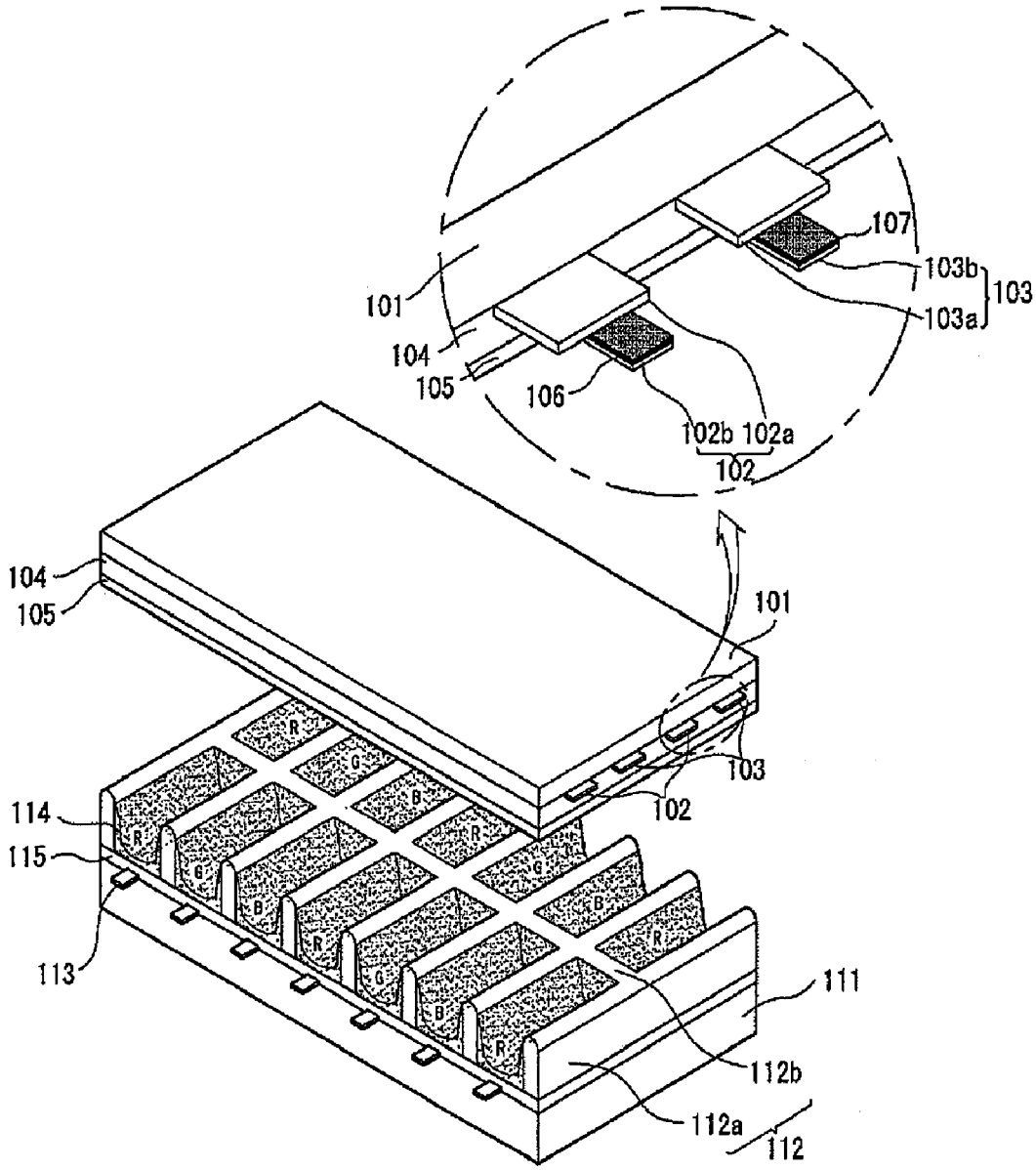
FIGS. 1 and 2 are diagrams for explaining an example of a structure of a plasma display panel according to the present invention.
Figure 2:
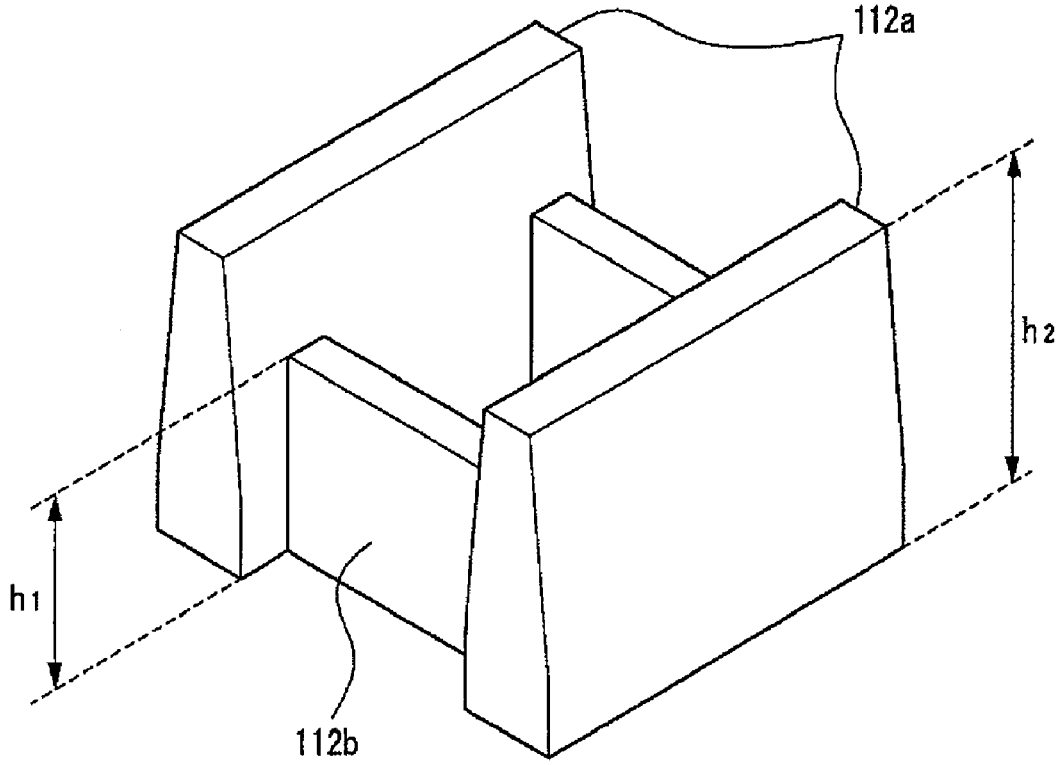

FIGS. 1 and 2 are diagrams for explaining an example of a structure of a plasma display panel according to the present invention.

As shown in FIG. 1, the plasma display panel according to the present invention may include a front substrate 101, on which a first electrode 102 (Y) and a second electrode 103 (Z) are formed parallel to each other, and a rear substrate 111 on which a third electrode 113 (X) is formed to intersect the first electrode 102 (Y) and the second electrode 103 (Z). A space between the front substrate 101 and the rear substrate 111 may be filled with a discharge gas including xenon (Xe), neon (Ne), and the like, It may be advantageous that a Xe content is equal to or more than 10% based on total weight of the discharge gas so as to improve the discharge efficiency.

The first electrode 102 and the second electrode 103 may each include transparent electrodes 102*a* and 103*a* and bus electrodes 102*b* and 103*b*.

The transparent electrodes 102*a* and 103*a* may include a substantially transparent material having electrical conductivity such as indium-tin-oxide (ITO).

The bus electrodes 102*b* and 103*b* may include a metal material having excellent electrical conductivity such as silver (Ag).

A first black layer 106 may be positioned on the front substrate 101 at a position corresponding to the first electrode 102, and a second black layer 107 may be positioned on the front substrate 101 at a position corresponding to the second electrode 103.

For instance, as shown in FIG. 1, in case that the first electrode 102 and the second electrode 103 each include the transparent electrodes 102*a* and 103*a* and the bus electrodes 102*b* and 103*b*, the first black layer 106 may be positioned between the transparent electrode 102*a* and the bus electrodes 102*b* of the first electrode 102, and the second black layer 107 may be positioned between the transparent electrode 103*a* and the bus electrodes 103*b* of the second electrode 103.

It may be preferable that a degree of darkness of the first and second black layers 106 and 107 is higher than a degree of darkness of the first electrode 102 or the second electrode 103. In other words, the first and second black layers 106 and 107 have a color darker than the first electrode 102 or the second electrode 103.

The first and second black layers 106 and 107 may be formed of the substantially same material. For instance, the first and second black layers 106 and 107 may include ruthenium (Ru)-based material or cobalt (Co)-based material.

The first and second black layers 106 and 107 prevent light coming from the outside from being reflected by the first and second electrodes 102 and 103, thereby reducing a reflectance.

An upper dielectric layer 104 may be positioned on the first electrode 102 and the second electrode 103 to limit a discharge current of the first electrode 102 and the second electrode 103 and to provide electrical insulation between the first electrode 102 and the second electrode 103.

A protective layer 105 may be formed on the upper dielectric layer 104 to facilitate discharge conditions. The protective layer 105 may include a material having a high secondary electron emission coefficient, for example, magnesium oxide (MgO).

The third electrode 113 is formed on the rear substrate 111, and a lower dielectric layer 115 may be formed on the third electrode 113 to provide electrical insulation of the third electrodes 113.

Barrier ribs 112 of a stripe type, a well type, a delta type, a honeycomb type, and the like, may be positioned on the lower dielectric layer 115 to partition discharge spaces (i.e., discharge cells). Hence, a first discharge cell emitting red (R) light, a second discharge cell emitting blue (B) light, and a third discharge cell emitting green (G) light, and the like, may be formed between the front substrate 101 and the rear substrate 111.

In addition to the first, second, and third discharge cells, a fourth discharge cell emitting white (W) light or yellow (Y) light may be further formed.

While widths of the first, second, and third discharge cells may be substantially equal to one another, a width of at least one of the first, second, and third discharge cells may be different from widths of the other discharge cells.

For instance, a width of the first discharge cell emitting red (R) light may be the smallest, and widths of the second discharge cell emitting blue (B) light and the third discharge cell emitting green (G) light may be larger than the width of the first discharge cell. Hence, a color temperature of a displayed image can be improved. The width of the second discharge cell may be substantially equal to or different from the width of the third discharge cell.

The plasma display panel may have various forms of barrier rib structures as well as a structure of the barrier rib 112 shown in FIG. 1. For instance, as shown in FIG. 2, the barrier rib 112 may include a first barrier rib 112*b* and a second barrier rib 112*a* that intersect each other, and may have a differential type barrier rib structure in which a height h1 of the first barrier rib 112*b* may be smaller than a height h2 of the second barrier rib 112*a*.

Further, the barrier rib 112 may have a channel type barrier rib structure in which a channel usable as an exhaust path is formed on at least one of the first barrier rib 112*b* or the second barrier rib 112*a*, a hollow type barrier rib structure in which a hollow is formed on at least one of the first barrier rib 112*b* or the second barrier rib 112*a*, and the like.

While FIG. 1 has shown and described the case where the first, second, and third discharge cells are arranged on the same line, the first, second, and third discharge cells may be arranged in a different pattern. For instance, a delta type arrangement in which the first, second, and third discharge cells are arranged in a triangle shape may be applicable. Further, the discharge cells may have a variety of polygonal shapes such as pentagonal and hexagonal shapes as well as a rectangular shape.

While FIG. 1 has shown and described the case where the barrier rib 112 is formed on the rear substrate 111, the barrier rib 112 may be formed on at least one of the front substrate 101 or the rear substrate 111.

A phosphor layer 114 may be positioned inside the discharge cells to emit visible light for an image display during an address discharge. For instance, first, second, and third phosphor layers that produce red, blue, and green light, respectively, may be positioned inside the discharge cells.

In addition to the first, second, and third phosphor layers, a fourth phosphor layer producing white and/or yellow light may be further positioned.

A thickness of at least one of the first, second, and third phosphor layers may be different from thicknesses of the other phosphor layers. For instance, a thickness of the second phosphor layer or the third phosphor layer may be larger than a thickness of the first phosphor layer. The thickness of the second phosphor layer may be substantially equal or different from the thickness of the third phosphor layer.

In FIG. 1, the upper dielectric layer 104 and the lower dielectric layer 115 each have a single-layered structure. However, at least one of the upper dielectric layer 104 and the lower dielectric layer 115 may have a multi-layered structure.

While the third electrode 113 may have a substantially constant width or thickness, a width or thickness of the third electrode 113 inside the discharge cell may be different from a width or thickness of the third electrode 113 outside the discharge cell. For instance, a width or thickness of the third electrode 113 inside the discharge cell may be larger than a width or thickness of the third electrode 113 outside the discharge cell.

Figure 3:
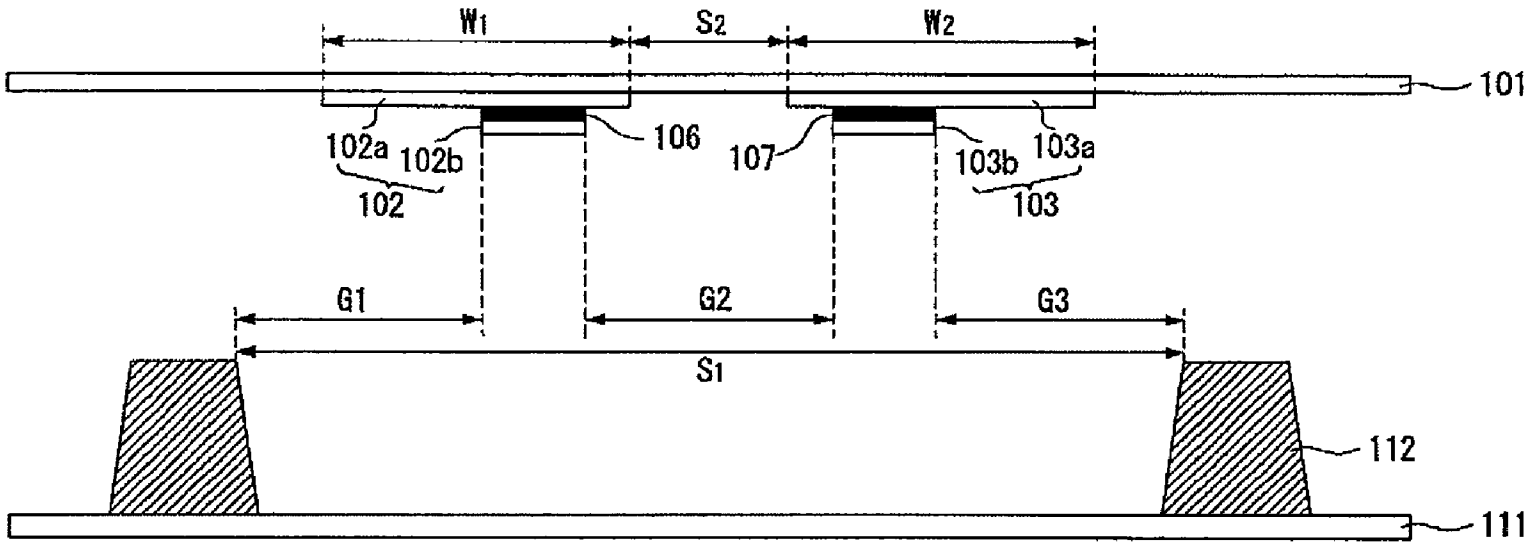
FIGS. 3 to 5 are diagrams for explaining in detail a structure of the plasma display panel according to the present invention.
Figure 4:
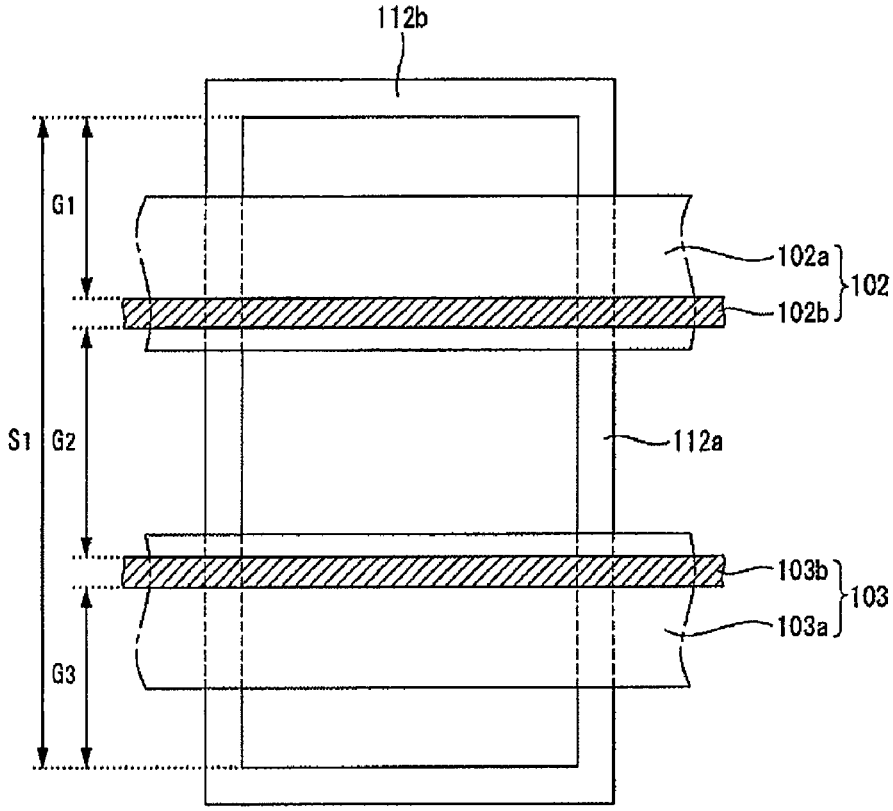
Figure 5:
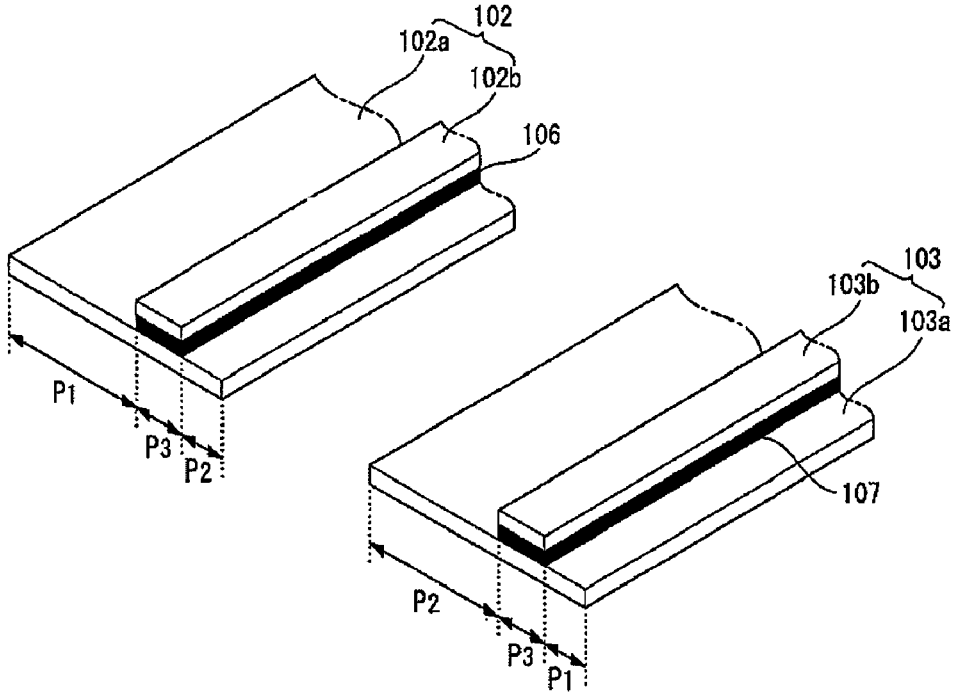

FIGS. 3 to 5 are diagrams for explaining in detail a structure of the plasma display panel according to the present invention.

As shown in FIGS. 3 and 4, a shortest interval between the first black layer 106 and the barrier rib 112, an interval between the first black layer 106 and the second black layer 107, and a shortest interval between the second black layer 107 and the barrier rib 112 are indicated as G1, G2, and G3, respectively.

At least one of the shortest interval G1 between the first black layer 106 and the barrier rib 112 and the shortest interval G3 between the second black layer 107 and the barrier rib 112 is set to be relatively wide. Preferably, the interval G2 between the first black layer 106 and the second black layer 107 may range from 0.7 to 2.5 times at least one of the shortest interval G1 between the first black layer 106 and the barrier rib 112 and the shortest interval G3 between the second black layer 107 and the barrier rib 112, Accordingly, a relationship of $0.7G1 \leqq G2 \leqq 2.5G1$ or $0.7G3 \leqq G2 \leqq 2.5G3$ is satisfied.

The first electrode 102 and the second electrode 103 may be spaced apart from the first barrier rib 112 parallel to at least one of the first electrode 102 and the second electrode 103 at a predetermined distance. Accordingly, it can be easier to satisfy the relationship of $0.7G1 \leqq G2 \leqq 2.5G1$ or $0.7G3 \leqq G2 \leqq 2.5G3$.

The shortest interval G1 between the first black layer 106 and the barrier rib 112 may be substantially equal to the shortest interval G3 between the second black layer 107 and the barrier rib 112.

In the present invention, the shortest interval G1 between the first black layer 106 and the barrier rib 112 is set at a shortest interval between upper portions of the first black layer 106 and the barrier rib 112, and the shortest interval G3 between the second black layer 107 and the barrier rib 112 is set at a shortest interval between upper portions of the second black layer 107 and the barrier rib 112. However, the shortest interval G1 between the first black layer 106 and the barrier rib 112 may be set at a shortest interval between lower portions of the first black layer 106 and the barrier rib 112, and the shortest interval G3 between the second black layer 107 and the barrier rib 112 may be set at a shortest interval between lower portions of the second black layer 107 and the barrier rib 112.

In case that an interval S2 between the first electrode 102 and the second electrode 103 is excessively wide, a firing voltage between the first electrode and the second electrode 103 may excessively rise. Therefore, the driving efficiency may be reduced.

On the other hand, in case that the interval S2 between the first electrode 102 and the second electrode 103 is excessively narrow, a positive column region during a discharge cannot be sufficiently used. Therefore, a luminance may be reduced.

Considering this, it may be advantageous that the interval S2 between the first electrode 102 and the second electrode 103 is equal to or more than approximately 80 μm, and preferably equal to or more than approximately 90 μm.

A width of each of the first electrode 102 and the second electrode 103 will be described below.

In case that widths W1 and W2 of the transparent electrodes 102*a* and 103*a* of the first and second electrodes 102 and 103 are excessively large, the interval S2 between the first electrode 102 and the second electrode 103 may be excessively narrow. Hence, because a positive column region during a discharge cannot be sufficiently used, the luminance may be reduced.

On the other hand, in case that the widths W1 and W2 of the transparent electrodes 102*a* and 103*a* of the first and second electrodes 102 and 103 are excessively small, electrical resistances of the first and second electrodes 102 and 103 are large. Hence, the driving efficiency may be reduced.

Considering this, it may be preferable that a sum (W1+W2) of the widths W1 and W2 of the transparent electrodes 102*a* and 103*a* of the first and second electrodes 102 and 103 ranges from 60% to 90% of a pitch S1 of the discharge cell (i.e., the distance S1 between the adjacent two barrier ribs 112 parallel to the first and second electrodes 102 and 103).

The transparent electrodes 102*a* and 103*a* of the first and second electrodes 102 and 103 will be described below in detail with reference to FIG. 5.

As shown in FIG. 5, each of the transparent electrodes 102*a* and 103*a* of the first and second electrodes 102 and 103 may include a first portion P1, a second portion P2, and a third portion P3. The first portion P1 does not overlap the first black layer 106 or the second black layer 107. The second portion P2 does not overlap the first black layer 106 or the second black layer 107, and a distance from the second portion P2 to the middle of the discharge cell is shorter than a distance from the first portion P1 to the middle of the discharge cell. The third portion P3 is positioned between the first portion P1 and the second portion P2 and overlaps the first black layer 106 or the second black layer 107.

A length of a cross section of the second portion P2 may be shorter than a length of a cross section of the first portion P1. In other words, the bus electrodes 102*b* and 103*b* of the first and second electrodes 102 and 103 may positioned on the transparent electrodes 102*a* and 103*a* to be close to the center of the discharge cell.

Figure 6:
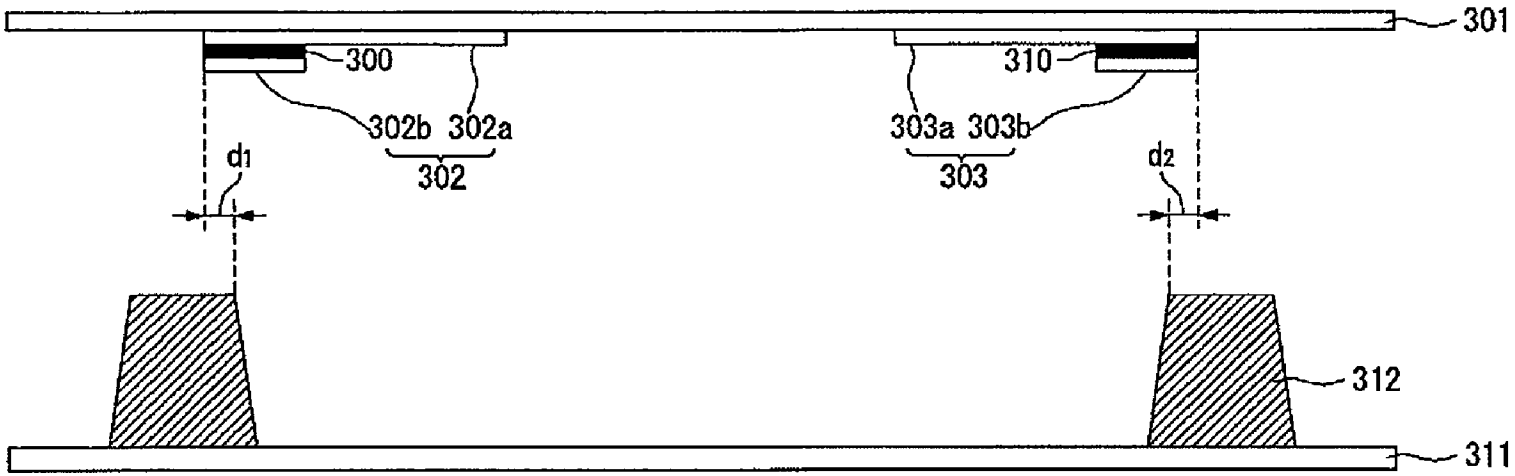
FIGS. 6 to 8 are diagrams for explaining a reason to relatively widen intervals between first and second black layers and a barrier rib.
Figure 7:
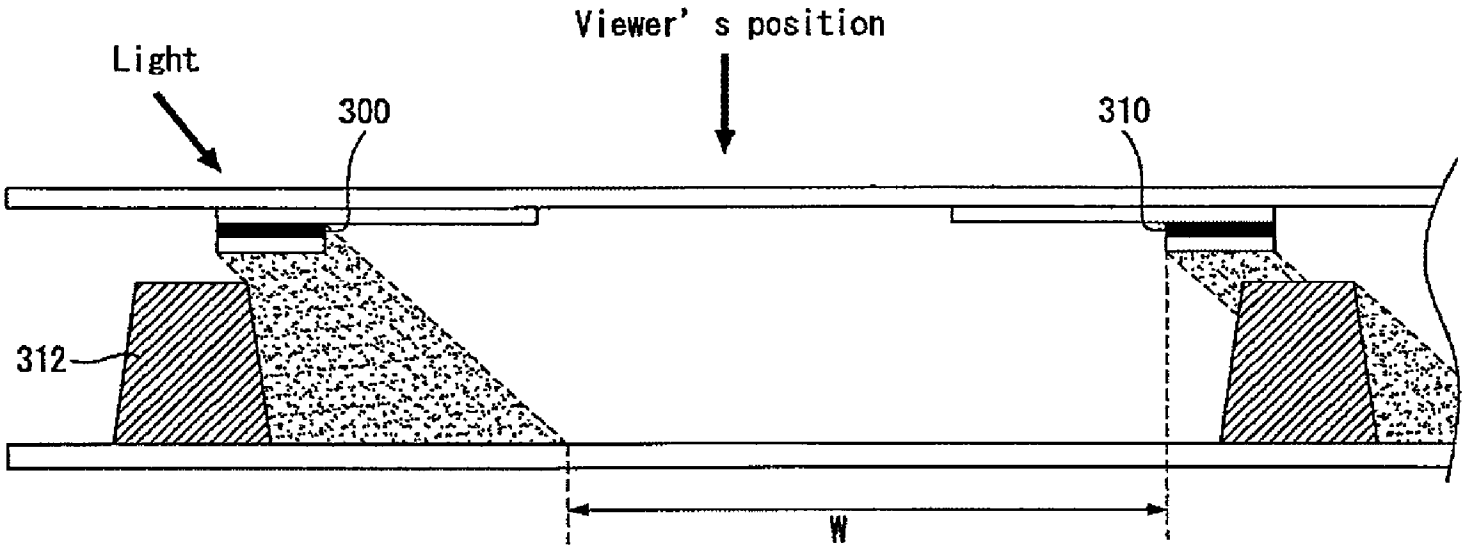
Figure 8:
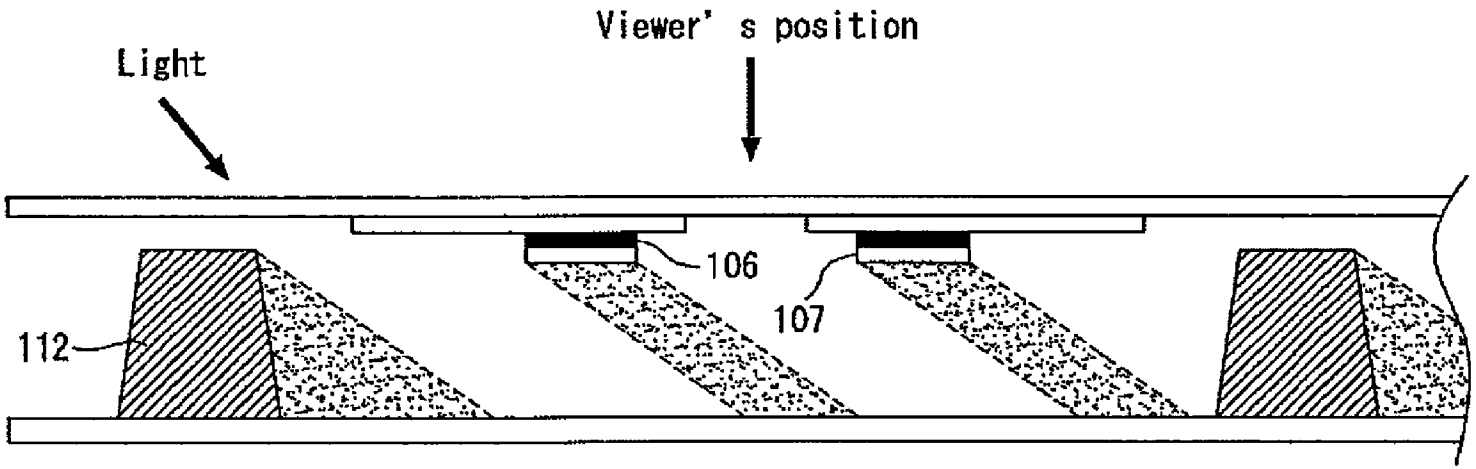

FIGS. 6 to 8 are diagrams for explaining a reason to relatively widen intervals between first and second black layers and a barrier rib.

Figure 9:
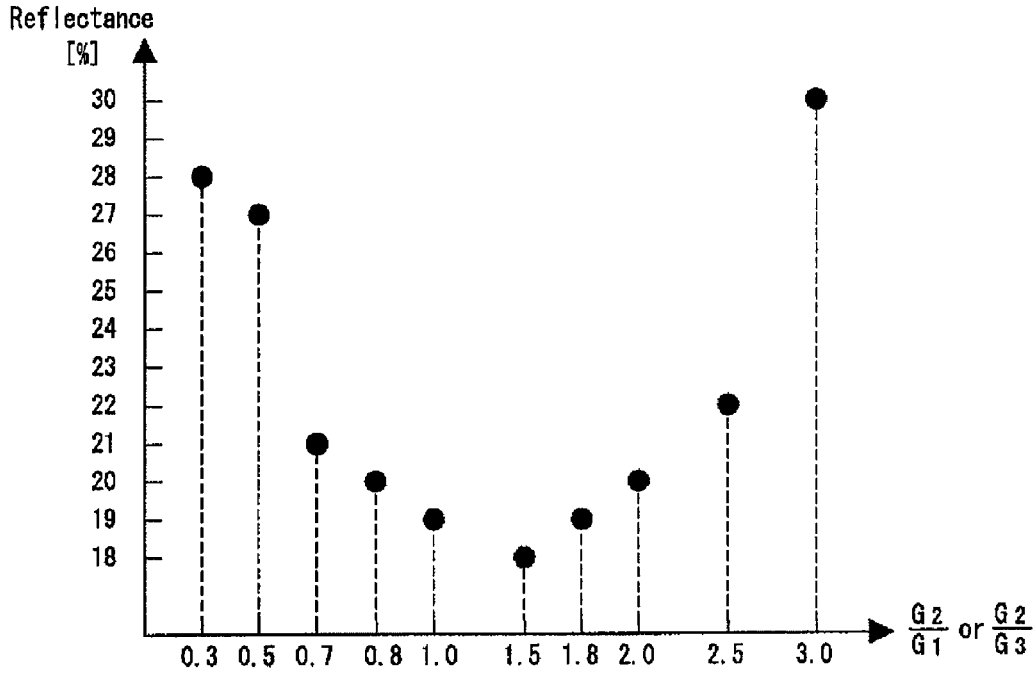
FIGS. 9 and 10 are graphs showing a relationship between a reflectance and a luminance of the plasma display panel according to an exemplary embodiment of the present invention.
Figure 10:
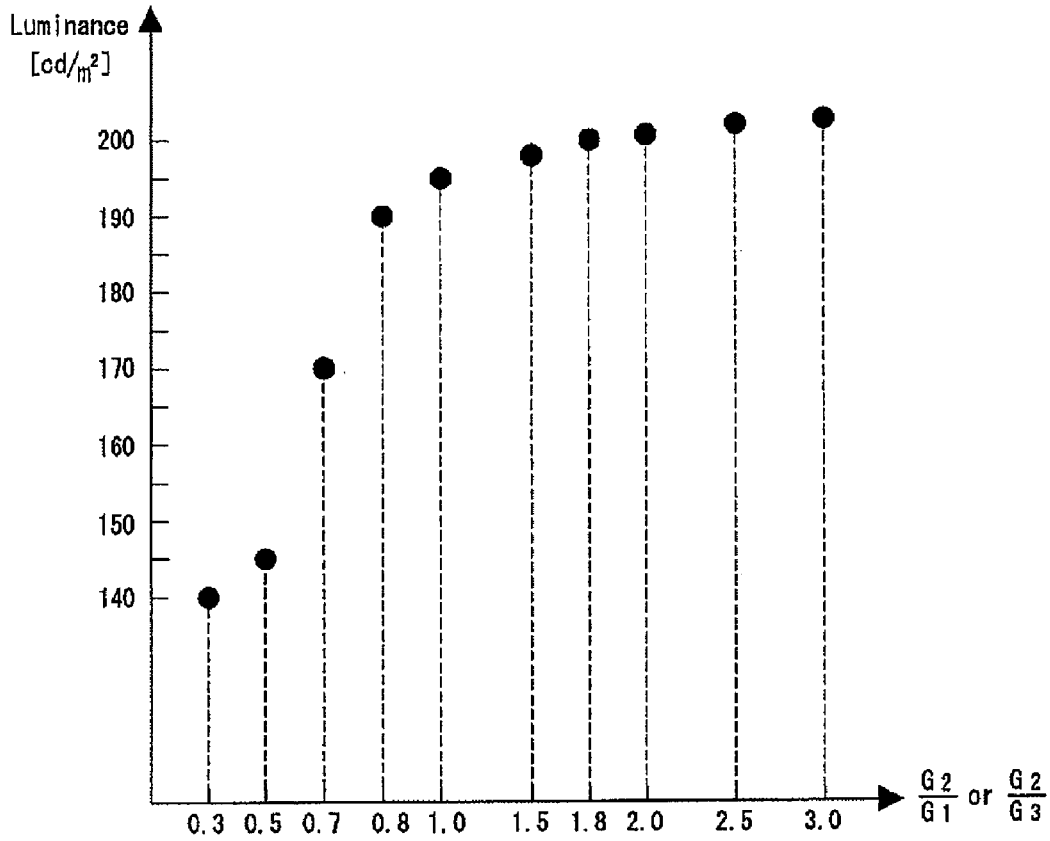

FIGS. 9 and 10 are graphs showing a relationship between a reflectance and a luminance of the plasma display panel according to an exemplary embodiment of the present invention.

FIG. 6 shows a case where a first black layer 300 or a second black layer 310 overlaps a barrier 312 in an area d1 or d2.

It is assumed that in the panel structure of FIG. 6, light, as shown in FIG. 7, is obliquely incident on the panel. Further, it is assumed that a viewer watches an image in front of the panel.

A portion of light rays obliquely incident on the panel is blocked by the first black layer 300, the second black layer 310, and the barrier 312, and thus a shadow generated by the first black layer 300, the second black layer 310, and the barrier 312 covers a portion of the discharge cell. However, because the first black layer 300 is adjacent to the barrier 312 or the second black layer 310 is adjacent to the barrier 312, as shown in FIG. 7, light coming from the outside may be reflected in an area W.

Accordingly, the viewer watches the light reflected in the area W, and thus a contrast characteristic of an image displayed on the panel may be reduced.

On the other hand, when the interval between the first black layer 106 and the barrier rib 112 or the interval between the second black layer 107 and the barrier rib 112 are relatively wide as shown in FIG. 3, a portion of light rays obliquely incident on the panel may be blocked by the first black layer 106, the second black layer 107, and the barrier rib 112 as shown in FIG. 8.

Because the interval between the first black layer 106 and the barrier rib 112 is sufficiently wide and also the interval between the second black layer 107 and the barrier rib 112 is sufficiently wide, a shadow generated by the first black layer 106, the second black layer 107, and the barrier rib 112 may cover the most area of the discharge cell.

Although the viewer in the front of panel watches an image displayed on the panel, an intensity of the reflected light which the viewer watches may be weaker than an intensity of the reflected light in the case described in FIGS. 6 and 7. Hence, a contrast characteristic of the image displayed on the panel can be improved. This is referred to as an eclipse effect.

FIGS. 9 and 10 show a luminance and a reflectance.

As show in FIG. 9, when the interval G2 between the first black layer 106 and the second black layer 107 ranges from 0.3 to 0.5 times at least one of the shortest interval G1 between the first black layer 106 and the barrier rib 112 and the shortest interval G3 between the second black layer 107 and the barrier rib 112, a shadow generated by the first black layer 106 and the second black layer 107 concentratedly covers a middle portion of the discharge cell, and an edge portion of the discharge cell is exposed. Hence, a panel reflectance may range from 27% to 28%.

When the interval G2 is 3.0 times the shortest interval G1 or G3, as shown in FIGS. 6 and 7, a shadow generated by the first black layer 106, the second black layer 107, and the barrier rib 112 covers only a portion of the discharge cell, and the most area of the discharge cell is exposed. Hence, the panel reflectance may sharply increase to approximately 30%.

On the other hand, when the interval G2 is 0.7 time the shortest interval G1 or G3, the panel reflectance may be sharply reduced to approximately 21%. When the interval G2 ranges from 0.7 to 2.5 times the shortest interval G1 or G3, the panel reflectance may have a stable value ranging from 18% to 22% because of the eclipse effect described in FIG. 8.

As show in FIG. 10, when the interval G2 between the first black layer 106 and the second black layer 107 ranges from 0.3 to 0.5 times at least one of the shortest interval G1 between the first black layer 106 and the barrier rib 112 and the shortest interval G3 between the second black layer 107 and the barrier rib 112, the first black layer 106 and the second black layer 107 cover the middle portion of the discharge cell in which a relatively large amount of light is generated. Hence, a luminance may have a relatively small value ranging from 140 cd/m$^2$ to 145 cd/m$^2$.

On the other hand, when the interval G2 ranges from 0.7 to 2.5 times the shortest interval G1 or G3, the middle portion of the discharge cell is open. Hence, the luminance may range from 170 cd/m$^2$ to 202 cd/m$^2$.

When the interval G2 exceeds 2.5 times the shortest interval G1 or G3, the luminance may saturate in a range between 202 cd/m$^2$ and 203 cd/m$^2$.

Considering the panel reflectance of FIG. 9 and the luminance of FIG. 10, it may be advantageous that the interval G2 between the first black layer 106 and the second black layer 107 ranges from 0.7 to 2.5 times at least one of the shortest interval G1 between the first black layer 106 and the barrier rib 112 and the shortest interval G3 between the second black layer 107 and the barrier rib 112, so as to reduce the panel reflectance and to improve the luminance.

It may be more advantageous that the interval G2 between the first black layer 106 and the second black layer 107 ranges from 0.7 to 2.0 times or from 0.8 to 1.8 times at least one of the shortest interval G1 between the first black layer 106 and the barrier rib 112 and the shortest interval G3 between the second black layer 107 and the barrier rib 112, so as to reduce the panel reflectance and to improve the luminance.

The interval G2 between the first black layer 106 and the second black layer 107 may be substantially equal to at least one of the shortest interval G1 between the first black layer 106 and the barrier rib 112 and the shortest interval G3 between the second black layer 107 and the barrier rib 112.

Figure 11:
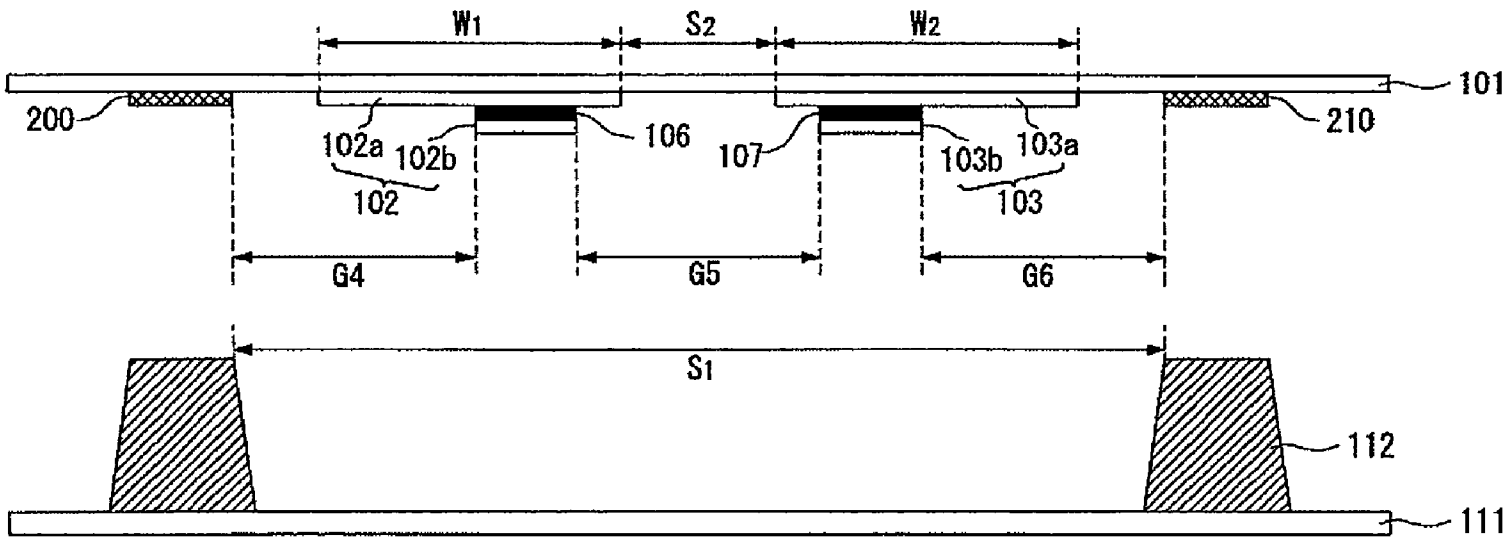
FIG. 11 is a diagram for explaining a third black layer.

FIG. 11 is a diagram for explaining a third black layer. Descriptions identical to the descriptions described above are omitted in FIG. 11.

As shown in FIG. 11, third black layers 200 and 210 may be positioned on the front substrate 101 at a position corresponding to the barrier rib 112, and may have a degree of darkness higher than a degree of darkness of at least one of the first electrode 102 and the second electrode 103.

In this case, a shortest interval between the third black layer 200 and the first black layer 106, a shortest interval between the first black layer 106 and the second black layer 107, and a shortest interval between the third black layer 210 and the second black layer 107 may be indicated as G4, G5, and G6, respectively.

A relationship of $0.7G4 \leqq G5 \leqq 2.5G4$ or $0.7G6 \leqq G5 \leqq 2.5G6$ may be satisfied so as to achieve an eclipse effect.

Comparing FIG. 11 with FIG. 3, the shortest interval G1 between the first black layer 106 and the barrier rib 112 in FIG. 3 may correspond to the shortest interval G4 between the third black layer 200 and the first black layer 106 in FIG. 11, the shortest interval G3 between the second black layer 107 and the barrier rib 112 in FIG. 3 may correspond to the shortest interval G6 between the third black layer 210 and the second black layer 107 in FIG. 11, and the shortest interval G2 in FIG. 3 may correspond to the shortest interval G5 in FIG. 11.

Widths of the third black layers 200 and 210 may be substantially equal to a width of an upper portion or a lower portion of the barrier rib 112. The widths of the third black layers 200 and 210 may be larger than the width of the upper portion or the lower portion of the barrier rib 112 by approximately 10 μm to 40 μm in consideration of an error of manufacturing process.

Figure 12:
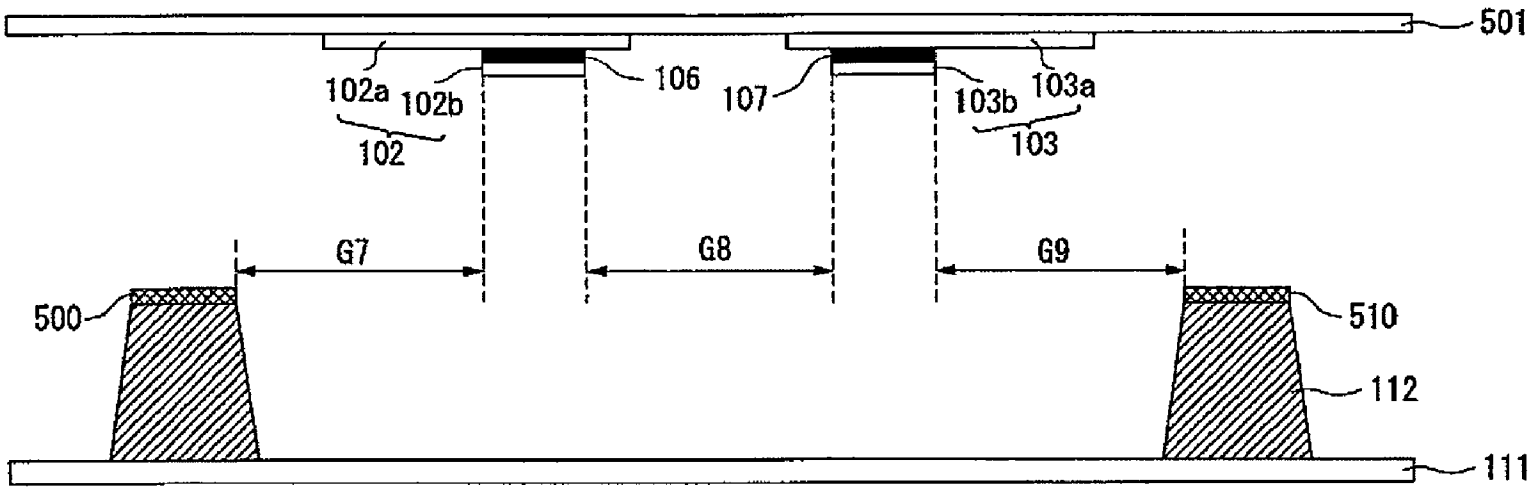
FIG. 12 is a diagram for explaining a fourth black layer.

FIG. 12 is a diagram for explaining a fourth black layer. Descriptions identical to the descriptions described above are omitted in FIG. 12.

As shown in FIG. 12, fourth black layers 500 and 510 may be positioned on an upper portion of the barrier rib 112, and may have a degree of darkness higher than a degree of darkness of the barrier rib 112.

In this case, a shortest interval between the fourth black layer 500 and the first black layer 106, a shortest interval between the first black layer 106 and the second black layer 107, and a shortest interval between the fourth black layer 510 and the second black layer 107 may be indicated as G7, G8, and G9, respectively.

A relationship of $0.7G7 \leqq G8 \leqq 2.5G7$ or $0.7G9 \leqq G8 \leqq 2.5G9$ may be satisfied so as to achieve the above-described eclipse effect.

Comparing FIG. 12 with FIG. 3, the shortest interval. G1 between the first black layer 106 and the barrier rib 112 in FIG. 3 may correspond to the shortest interval G7 between the fourth black layer 500 and the first black layer 106 in FIG. 12, the shortest interval G3 between the second black layer 107 and the barrier rib 112 in FIG. 3 may correspond to the shortest interval G9 between the fourth black layer 510 and the second black layer 107 in FIG. 12, and the shortest interval G2 in FIG. 3 may correspond to the shortest interval G8 in FIG. 12.

Figure 13:
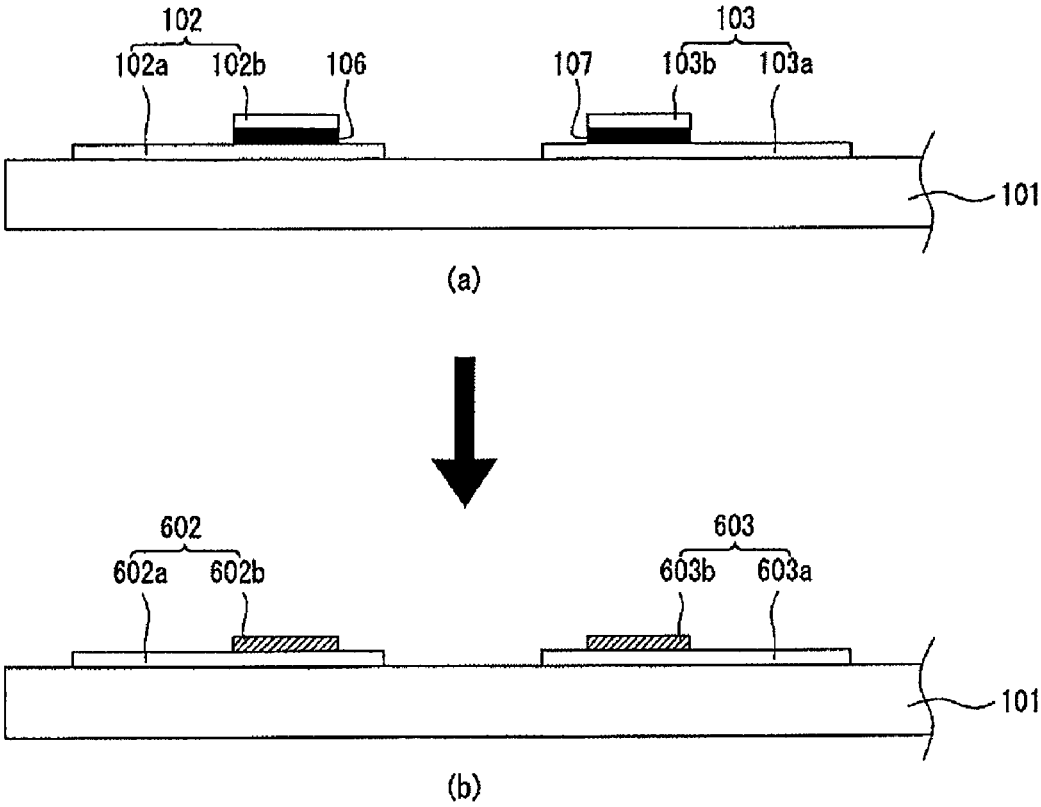
FIGS. 13 and 14 are diagrams for explaining another structure of a bus electrode.
Figure 14:
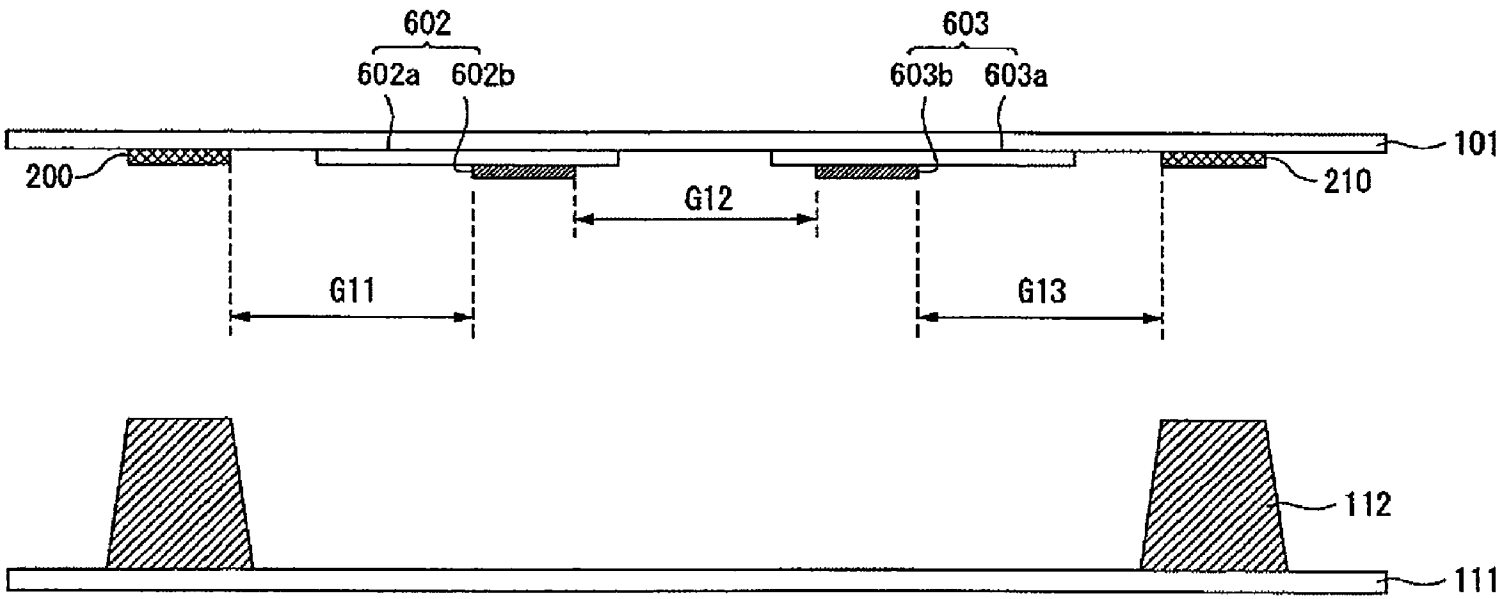

FIGS. 13 and 14 are diagrams for explaining another structure of a bus electrode. Descriptions identical to the descriptions described above are omitted in FIGS. 13 and 14.

As shown in FIG. 13, (a) shows a case where the first electrode 102 and the second electrode 103 each include the transparent electrodes 102*a* and 103*a* and the bus electrodes 102*b* and 103*b*, the first black layer 106 is positioned between the transparent electrodes 102*a* and the bus electrode 102*b* of the first electrode 102, and the second black layer 107 is positioned between the transparent electrodes 103*a* and the bus electrode 103*b* of the second electrode 103.

As shown in (b) of FIG. 13, the first and second black layers 106 and 107 are combined with the bus electrodes 102*b* and 103*b*, and bus electrodes 602*b* and 603*b* may be formed.

As above, the bus electrodes 602*b* and 603*b* combined with the first and second black layers 106 and 107 may be formed of a material obtained by mixing an electrode material with a black material having a degree of darkness higher than a degree of darkness of the electrode material.

Because the formation of the bus electrodes 602*b* and 603*b* combined with the black layer reduces the number of manufacturing processes and time required in the manufacturing process, the manufacturing cost can be reduced.

In this case, as shown in FIG. 14, a shortest interval between the bus electrode 602*b* of a first electrode 602 and the third black layer 200, an interval between the bus electrodes 602*b* and 603*b* of the first and second electrodes 602 and 603, and a shortest interval between the bus electrode 603*b* of the second electrode 603 and the third black layer 210 may be indicated as G11, G12, and G13, respectively.

A relationship of $0.7G11 \leqq G12 \leqq 2.5G11$ or $0.7G13 \leqq G12 \leqq 2.5G13$ may be satisfied so as to achieve the above-described eclipse effect.

Comparing FIG. 14 with FIG. 3, the shortest interval G1 between the first black layer 106 and the barrier rib 112 in FIG. 3 may correspond to the shortest interval G11 between the third black layer 200 and the bus electrode 602*b* of the first electrode 602 in FIG. 14, the shortest interval G3 between the second black layer 107 and the barrier rib 112 in FIG. 3 may correspond to the shortest interval G13 between the third black layer 210 and the bus electrode 603*b* of the second electrode 603 in FIG. 14, and the shortest interval G2 in FIG. 3 may correspond to the interval G8 in FIG. 14.

Figure 15:
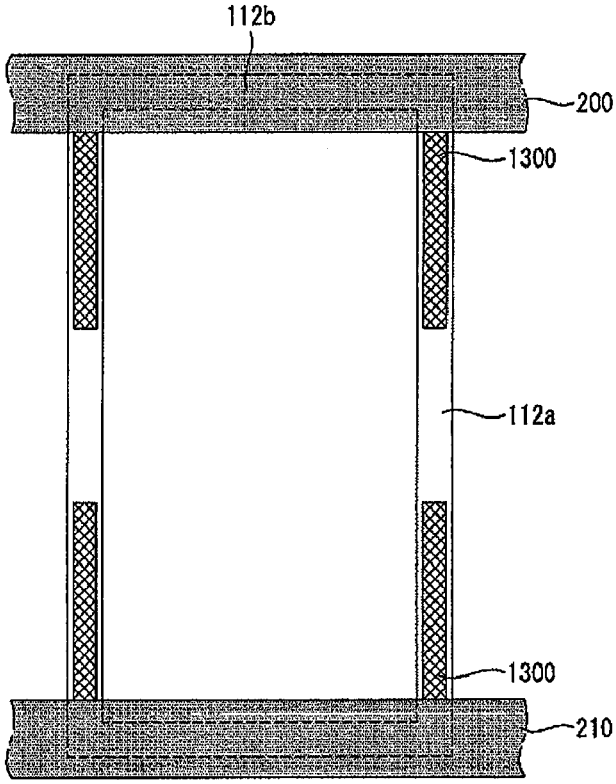
FIGS. 15 and 16 are diagrams for explaining a fifth black layer.
Figure 16:
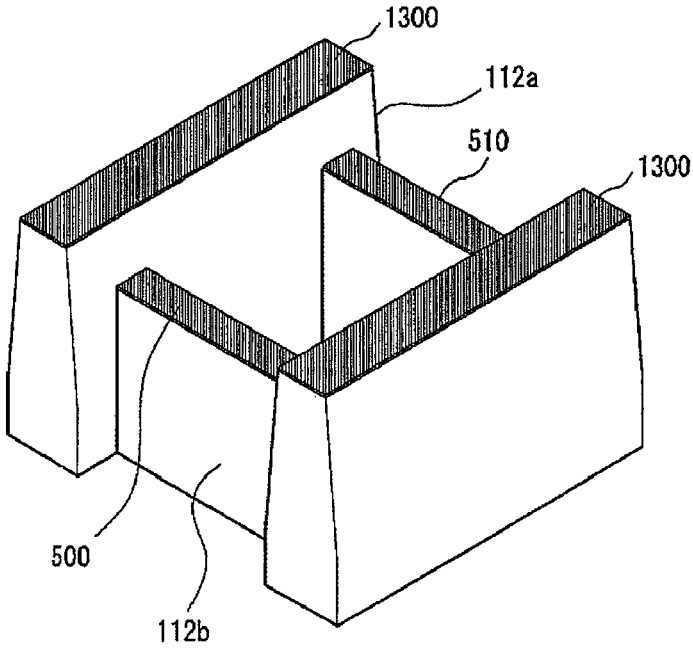

FIGS. 15 and 16 are diagrams for explaining a fifth black layer.

As shown in FIG. 15, the barrier rib 112 includes the first barrier rib 112*b* parallel to the third black layers 200 and 210, and the second barrier rib 112*a* intersecting the first barrier rib 112*b*. A fifth black layer 1300 intersecting the third black layers 200 and 210 may be positioned on the front substrate (not shown) at a position corresponding to the second barrier rib 112*a*.

Although it is not shown in FIG. 15, the fifth black layer 1300 may intersect the first black layer (not shown) and the second black layer (not shown).

A portion of the fifth black layer 1300, as shown in FIG. 15, may be omitted at the position corresponding to the second barrier rib 112*a*. Preferably, a portion of the fifth black layer 1300 may be omitted at a position corresponding to a middle portion of the discharge cell. As above, in case that the portion of the fifth black layer 1300 is omitted at the position corresponding to the middle portion of the discharge cell, an excessive reduction in the luminance can be prevented.

As shown in FIG. 16, the fifth black layer 1300 may be positioned on an upper portion of the second barrier rib 112*a*.

The formation of the fifth black layer 1300 can further reduce the panel reflectance, and thus the contrast characteristic of the image can be improved.

Figure 17:
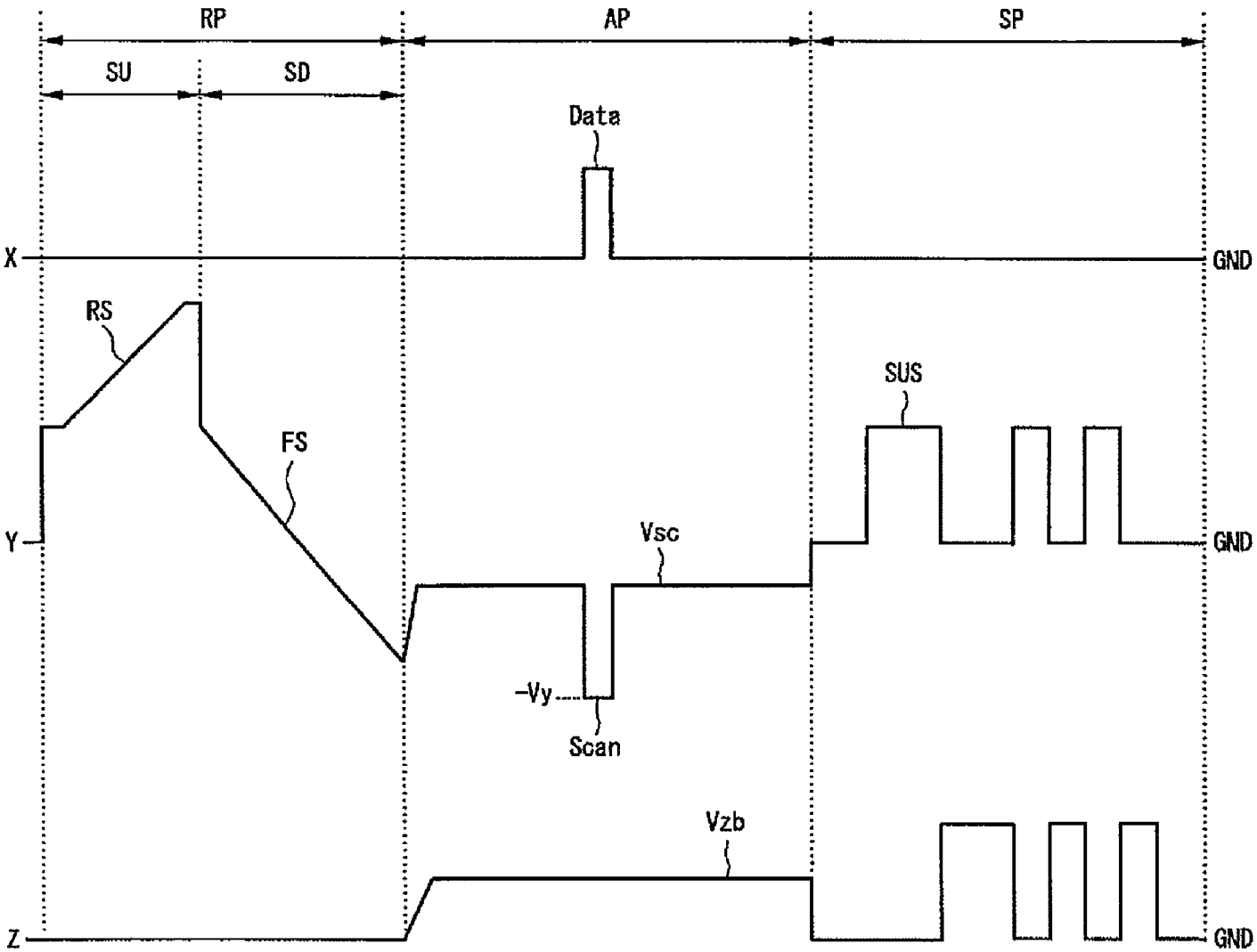
FIG. 17 is a diagram for explaining a method of driving the plasma display panel.

FIG. 17 is a diagram for explaining a method of driving the plasma display panel.

As shown in FIG. 17, a rising signal RS and a falling signal FS may be supplied to the scan electrode Y during a reset period RP for initialization of at least one subfield of a plurality of subfields of a frame.

For instance, the rising signal RS may be supplied to the scan electrode Y during a setup period SU of the reset period RP, and the falling signal FS may be supplied to the scan electrode Y during a set-down period SD following the setup period SU.

When the rising signal RS is supplied to the scan electrode Y, a weak dark discharge (i.e., a setup discharge) occurs inside the discharge cell due to the rising signal RS. Hence, the remaining wall charges may be uniformly distributed inside the discharge cell.

When the falling signal FS is supplied to the scan electrode Y after the supply of the rising signal RS, a weak erase discharge (i.e., a set-down discharge) occurs inside the discharge cell. Hence, the remaining wall charges may be uniformly distributed inside the discharge cells to the extent that an address discharge occurs stably.

During an address period AP following the reset period RP, a scan bias signal Vsc having a voltage higher than a lowest voltage of the falling signal FS may be supplied to the scan electrode Y.

A scan signal Scan falling from the scan bias signal Vsc may be supplied to the scan electrode Y during the address period AP.

A width of a scan signal supplied to the scan electrode during an address period of at least one subfield may be different from widths of scan signals supplied during address periods of the other subfields. For instance, a width of a scan signal in a subfield may be larger than a width of a scan signal in a next subfield in time order. A width of a scan signal may be gradually reduced in the order of 2.6 μs, 2.3 μs, 2.1 μs, 1.9 μs, etc., or may be reduced in the order of 2.6 μs, 2.3 μs, 2.3 μs, 2.1 μs, ? 1.9 μs, 1.9 μs, etc., in the successively arranged subfields.

When the scan signal Scan is supplied to the scan electrode Y, a data signal Data corresponding to the scan signal Scan may be supplied to the address electrode X.

As the voltage difference between the scan signal Scan and the data signal Data is added to a wall voltage by the wall charges produced during the reset period RP, an address discharge can occur inside the discharge cells to which the data signal Data is supplied.

During a sustain period SP following the address period AP, a sustain signal SUS may be supplied to at least one of the scan electrode Y or the sustain electrode Z. For instance, the sustain signal SUS may be alternately supplied to the scan electrode Y and the sustain electrode Z.

As the wall voltage inside the discharge cells selected by performing the address discharge is added to a sustain voltage Vs of the sustain signal SUS, every time the sustain signal SUS is supplied, a sustain discharge (i.e., a display discharge) can occur between the scan electrode Y and the sustain electrode Z. Hence, an image can be displayed on the screen of the plasma display panel.

While the present invention have been described with reference to the attached drawings, it will be understood by those of ordinary skill in the art that various changes in form and details may be made therein without departing from the spirit and scope of the present invention.

Rather, the exemplary embodiments of the present invention are provided so that this disclosure will be thorough and complete and fully conveys the concept of the invention to those of ordinary skill in the art. Such variations are not to be regarded as a departure from the spirit and scope of the invention, and all such modifications as would be obvious to those of ordinary skilled in the art are intended to be included within the scope of the following claims.

The invention claimed is:

1. A plasma display panel comprising:

a front substrate on which a first electrode and a second electrode are positioned substantially parallel to each other, the first electrode and the second electrode each including a transparent electrode and a bus electrode;

a first black layer positioned between the transparent electrode and the bus electrode of the first electrode;

a second black layer positioned between the transparent electrode and the bus electrode of the second electrode;

a rear substrate on which a third electrode is positioned crossing the first electrode and the second electrode when viewed perpendicular to a plane including the rear substrate, the rear substrate being positioned opposite the front substrate; and a barrier rib positioned between the front substrate and the rear substrate to partition a discharge cell, wherein the barrier rib includes a first barrier rib portion substantially parallel to the first and second black layers, and a second barrier rib portion intersecting the first barrier rib portion, wherein a height of the first barrier rib portion is smaller than a height of the second barrier rib portion, wherein the first barrier rib portion intersects with the third electrode, wherein an interval between the first black layer and the second black layer ranges from 0.7 to 2.5 times a shortest interval between at least one of the first and second black layers and the first barrier rib portion, wherein each of the transparent electrodes of the first and second electrodes includes:

a first portion that does not overlap a corresponding black layer of the first or second black layers;

a second portion that does not overlap the corresponding black layer, a distance from the middle of the second portion to the middle of the discharge cell being shorter than a distance from the middle of the first portion to the middle of the discharge cell; and a third portion that is positioned between the first portion and the second portion and overlaps the corresponding black layer, wherein a width of a cross section of the second portion is shorter than a width of a cross section of the first portion, and wherein the second portion of the first electrode and the second portion of the second electrode are both positioned between the first black layer and the second black layer.

2. The plasma display panel of claim 1, further comprising a third black layer on the front substrate at a position corresponding to the barrier rib.

3. The plasma display panel of claim 1, further comprising a fourth black layer on an upper portion of the barrier rib.

4. The plasma display panel of claim 3, wherein a shortest interval between at least one of the first and second black layers and the fourth black layer is substantially equal to the shortest interval between at least one of the first and second black layers and the first barrier rib portion.

5. The plasma display panel of claim 1, wherein the first electrode and the second electrode are spaced apart from the first barrier rib parallel to at least one of the first electrode and the second electrode.

6. The plasma display panel of claim 1, wherein a fifth black layer is positioned on the front substrate at a position corresponding to the second barrier rib portion to intersect the first and second black layers.

7. The plasma display panel of claim 6, wherein:

wherein the barrier rib includes a third barrier rib portion substantially parallel to the first barrier rib portion and intersecting the second barrier rib;

in a direction parallel to the second barrier rib portion, the fifth black layer includes a first black portion adjacent to the first barrier rib portion and a second black portion adjacent to the third barrier rib portion, the first black portion and the second black portion are separated.

8. The plasma display panel of claim 1, further comprising a third black layer on the front substrate at a position corresponding to the barrier rib, wherein, in a direction parallel to the third electrode, the shortest interval between the third black layer and the first black layer, the shortest interval between the third black layer and the second black layer, and the shortest interval between the first black layer and the second black layer are substantially equal to one another.

* * * * *